US008243001B2

(12) United States Patent
Lin

(10) Patent No.: US 8,243,001 B2
(45) Date of Patent: Aug. 14, 2012

(54) LIQUID CRYSTAL DISPLAY MODULE AND METHOD FOR USING THE SAME

(75) Inventor: Szu-Ying Lin, Tu-Cheng (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 577 days.

(21) Appl. No.: 12/506,337

(22) Filed: Jul. 21, 2009

(65) Prior Publication Data

US 2010/0277407 A1 Nov. 4, 2010

(30) Foreign Application Priority Data

Apr. 30, 2009 (CN) ..... 2009 1 0302018

(51) Int. Cl.
*G09G 3/36* (2006.01)

(52) U.S. Cl. ..... 345/99; 345/94

(58) Field of Classification Search ..... 345/98–100, 345/94, 95

See application file for complete search history.

(56) References Cited

U.S. PATENT DOCUMENTS

| | | | | |
|---|---|---|---|---|
| 7,209,111 | B2 * | 4/2007 | Kurokawa et al. | 345/99 |
| 7,786,966 | B2 * | 8/2010 | Nakanishi et al. | 345/89 |
| 2005/0093808 | A1 * | 5/2005 | Kang et al. | 345/99 |
| 2008/0180430 | A1 * | 7/2008 | Eriguchi et al. | 345/212 |
| 2009/0231323 | A1 * | 9/2009 | Kang et al. | 345/213 |

FOREIGN PATENT DOCUMENTS

CN 101231835 A 7/2008

* cited by examiner

*Primary Examiner* — Ricardo L Osorio
(74) *Attorney, Agent, or Firm* — Altis Law Group, Inc.

(57) ABSTRACT

A liquid crystal display (LCD) module includes a display unit for displaying images, a temporary storage unit electronically connected to the display unit for temporarily storing image data, and a timing unit electronically connected to the display unit. The display unit displays images corresponding to the image data stored in the temporary storage unit, and the timing unit generates a synchronous signal corresponding to the displaying operation.

8 Claims, 5 Drawing Sheets

LIQUID CRYSTAL DISPLAY MODULE AND METHOD FOR USING THE SAME

BACKGROUND

1. Technical Field

The present disclosure relates to liquid crystal displays (LCD) and methods for using the same, and particularly to an LCD module capable of preventing an image tearing effect and a method for using the same.

2. Description of Related Art

Liquid crystal displays (LCD) are widely used in electronic devices for displaying images. In use, an LCD is mounted on an electronic device and is connected to a central processing unit (CPU) of the electronic device. The CPU sends image data to a random access memory (RAM) of the LCD to temporarily store the image data, and the LCD displays images according to the image data currently stored in the RAM.

When using the electronic device to play a video file, the LCD need to display a plurality of images in a predetermined order at a predetermined speed, such that the continuous displayed images form a video. Thus, when the electronic device plays a video file (i.e., formed by a plurality of images), the CPU periodically sends image data of the video file to the RAM of the LCD to temporarily store and periodically renew the image data, and the LCD periodically displays images according to the image data currently stored in the RAM. After the LCD displays an image corresponding to the data currently stored in the RAM, the CPU sends new image data to the RAM to renew the stored data, and the LCD to display a next image according to the renewed image data. In this way, the plurality of images of the video file can be continually displayed.

However, in the electronic device, the CPU and the LCD may have different working frequencies. Therefore, speed of renewing the data stored in the RAM can be different to the speed of displaying images according to the currently stored data, which may cause the CPU and the LCD to work asynchronously. For example, referring to FIG. 4 and FIG. 5, which are sequence diagrams of two typical electronic devices used to display images. Working signals of the CPU in a high electric level indicate that the CPU is renewing the data stored in the RAM, and working signals of the LCD in a high electric level indicate that the LCD is displaying images according to the currently stored data. In the times A, B shown in FIG. 4 and the times C, D shown in FIG. 5, the CPU begins and does not completely renew the data stored in the RAM, and the LCD has already begun to display images according to data currently stored in the RAM. Thus, some renewed data and some old data requiring to be renewed may be both stored in the RAM, and an image including both a part corresponding to the renewed data and another part corresponding to the old data will be displayed by the LCD. This error is called a "tearing effect".

Therefore, there is room for improvement within the art.

BRIEF DESCRIPTION OF THE DRAWINGS

Many aspects of the present LCD module and method for using the same can be better understood with reference to the following drawings. The components in the various drawings are not necessarily drawn to scale, the emphasis instead being placed upon clearly illustrating the principles of the present LCD module and method for using the same. Moreover, in the drawings, like reference numerals designate corresponding parts throughout the figures.

DETAILED DESCRIPTION

Figure 1:
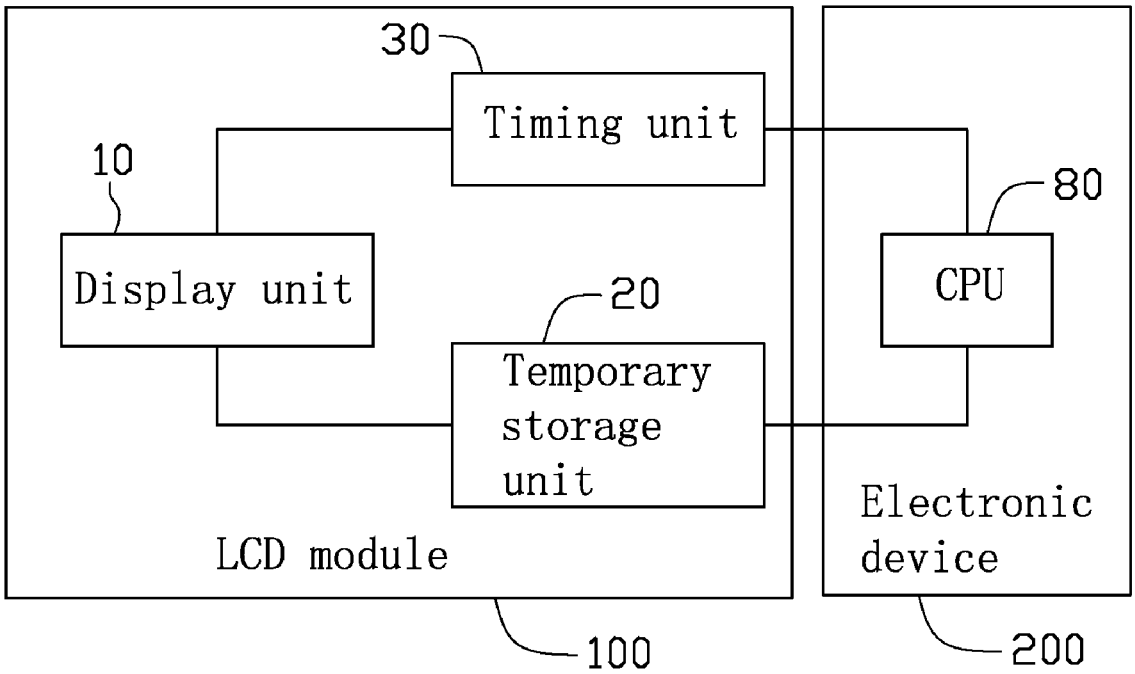
FIG. 1 is a block diagram of an LCD module, according to an exemplary embodiment.

Referring to FIG. 1, a liquid crystal display (LCD) module 100 according to an exemplary embodiment is provided. The LCD module 100 is electronically connected to a central processing unit (CPU) 80 of the electronic device 200 (i.e., can also be installed in an electronic device 200) to display images.

The LCD module 100 includes a display unit 10, a temporary storage unit 20 and a timing unit 30. The display unit 10 is a display screen for displaying images. The temporary storage unit 20 is a random access memory (RAM) electronically connected to the display unit 10 and the CPU 80 for temporarily storing image data. The display unit 10 can display images according to data currently stored in the temporary storage unit 20, and the CPU 80 can renew the stored data. The timing unit 30 is a timer chip electronically connected to the display unit 10 and the CPU 80. The timing unit 30 can generate synchronous signals corresponding to the working status of the LCD module 100 and send the signals to the CPU 80 to regulate the working status of the CPU 80, thereby preventing tearing effect.

Figure 2:
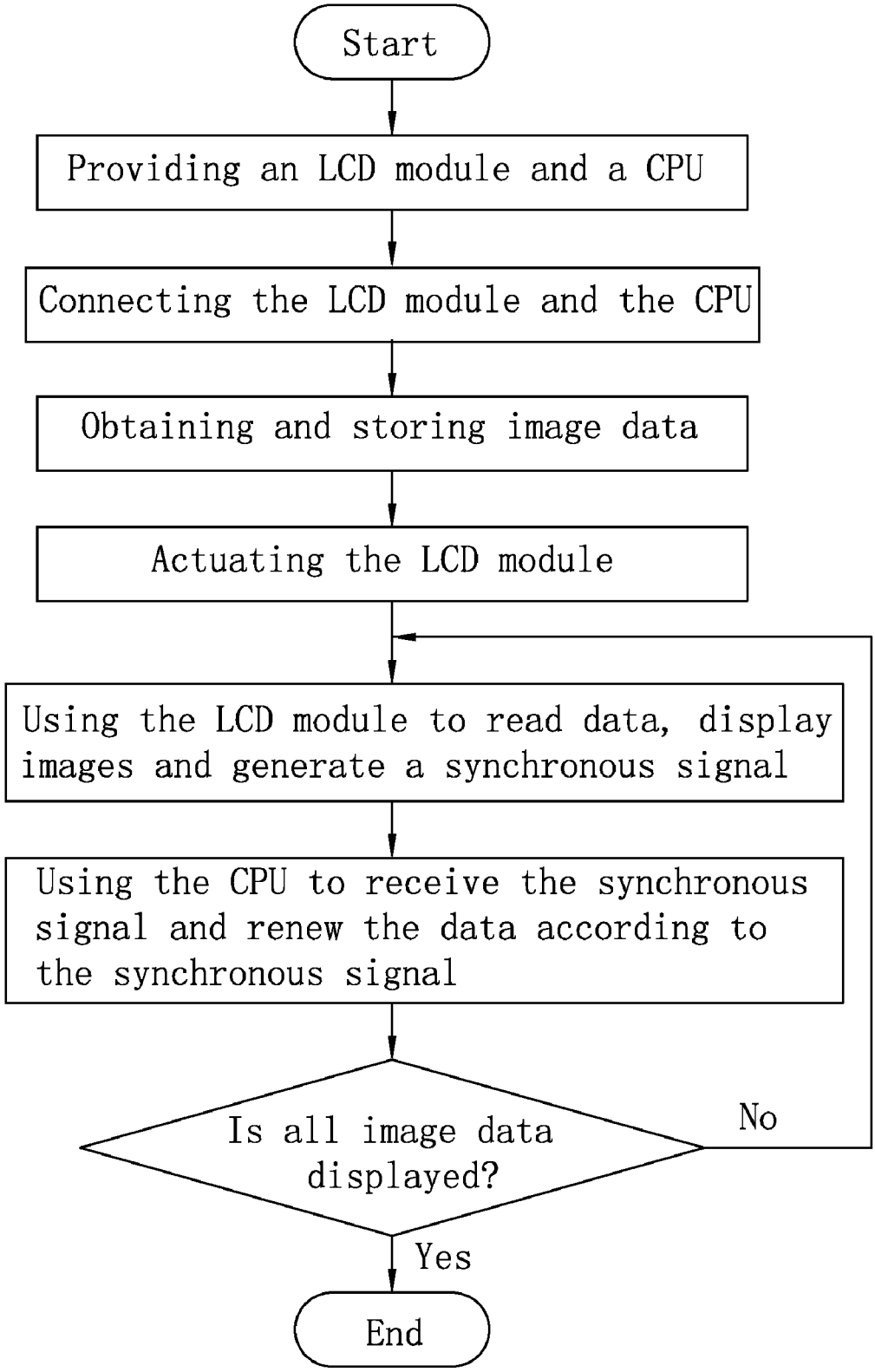
FIG. 2 is a flow chart of an image displaying method, according to an exemplary embodiment.
Figure 3:
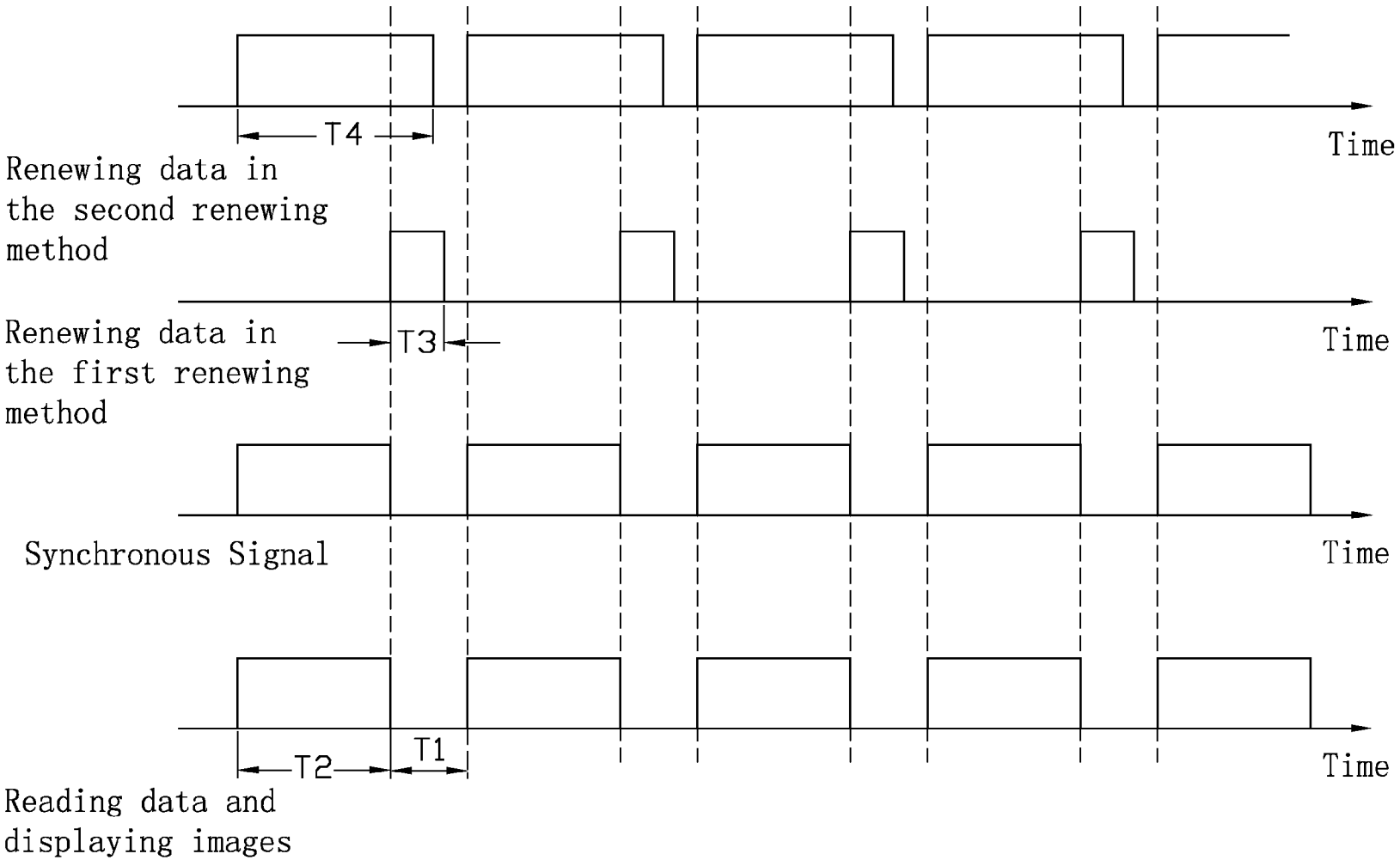
FIG. 3 is a working sequence diagram of the LCD module shown in FIG. 1.
Figure 4:
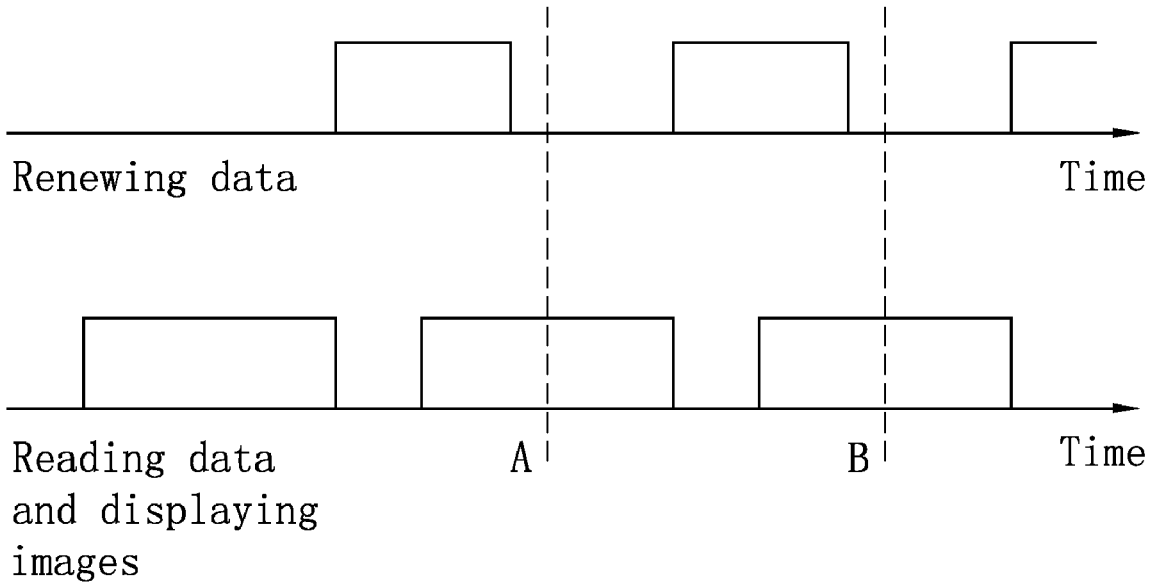
FIG. 4 (RELATED ART)
FIG. 4 is a working sequence diagram of a conventional LCD module.
Figure 5:
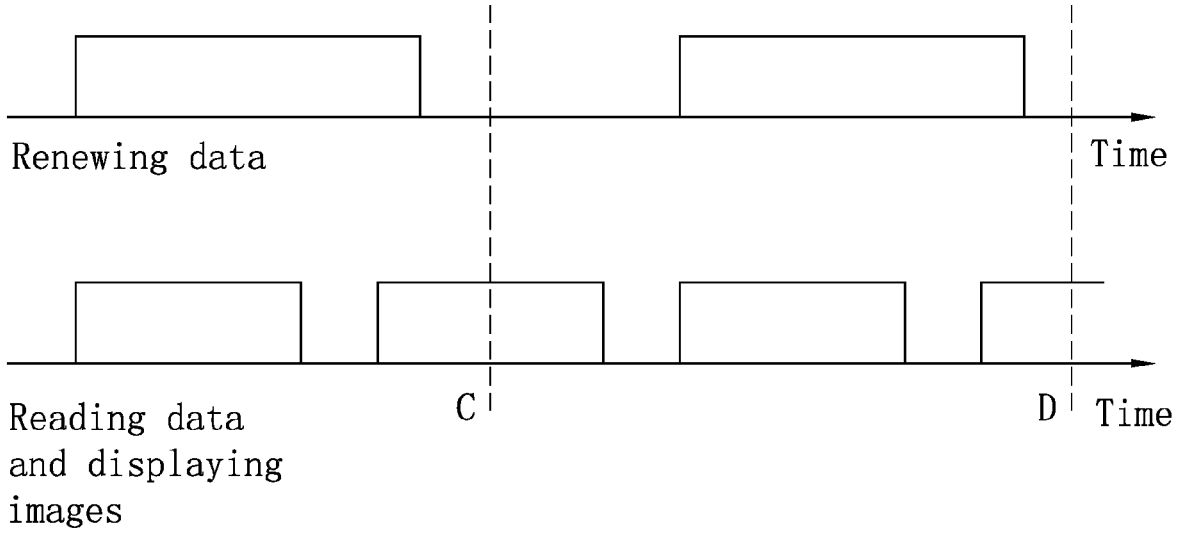
FIG. 5 (RELATED ART)
FIG. 5 is a working sequence diagram of another conventional LCD module.

Also referring to FIG. 2 and FIG. 3, a method for displaying images by the LCD module 100, according to an exemplary embodiment, is provided. The method may include the following steps.

First, the LCD module 100 and the electronic device 200 are provided. The LCD module 100 is electronically connected to the electronic device 200. Particularly, the temporary storage unit 20 and the timing unit 30 are both electronically connected to the CPU 80.

The CPU 80 is used to obtain image data requiring to be displayed, such as video files. The image data can be stored in conventional storages of the electronic device 200 (e.g., hard disks or memory cards) before being displayed.

When the electronic device 200 is used to play video files, the LCD module 100 needs to display a plurality of images in a predetermined order and at a predetermined speed, such that the continuous displayed images form a video. Thus, the LCD module 100 is actuated. Particularly seen in FIG. 3, the LCD module 100 periodically displays images corresponding to the image data currently stored in the temporary storage unit 20 by the display unit 10. A standby interval time between two adjacent displaying operations is T1, and the time of each displaying operation is T2. The timing unit 30 generates a synchronous signal corresponding to the working status of the LCD module 100 and sends the synchronous signal to the CPU 80. In the standby intervals T1, the synchronous signal is set to be in a low electric level. In the operation periods T2, the synchronous signal is set to be in a high electric level.

When the CPU 80 receives the synchronous signal, the CPU 80 begins to send new image data to the temporary storage unit 20 to renew the stored data according to the synchronous signal. The time of each renewing operation is T3 or T4. According to the lengths of the times T3 and T4, the CPU 80 can select one of two renewing methods as follows.

If the renewing time T3 is equal to or shorter than the standby time T1, the CPU 80 selects a first renewing method, wherein the descend edges of the synchronous signal (i.e., the end of each period T2) are used to drive the CPU 80 to renew the data stored in the temporary storage unit 20. Particularly, the CPU 80 first starts to renew the stored data when the LCD module 100 completes the first operation of displaying images (the end of the first period T2), and each renewing operation (the period T3) begins on a descend edge of the synchronous signal (i.e., the end of a period T2). Thus, each renewing operation (the period T3) can be completed before the LCD module 100 begins the next operation of displaying image (i.e., before a standby interval T1 ends and a next period T2 comes). As seen from FIG. 3, since T3≦T1, before the next operation of displaying image (a next period T2) begins, renewed data has already been completely stored in the temporary storage unit 20. Thus, the LCD module 100 can display an image corresponding to the renewed data by the display unit 10 when each period T2 begins, thereby preventing tearing effect from occurring.

If the renewing time T4 is longer than the standby time T1, the CPU 80 selects a second renewing method, wherein the ascend edges of the synchronous signal (i.e., the beginning of each period T2) are used to drive the CPU 80 to renew the data stored in the stored unit 20. Particularly, when the LCD module 100 first starts to display images according to the currently stored image data (i.e., the beginning of the first period T2), the CPU 80 starts to renew the data stored in the temporary storage unit 20. As seen from FIG. 3, if only T4≦T1+T2, each renewing operation (i.e., a period T4) can begin at a same time as a beginning of a period T2, and can complete before the next operation of displaying image (i.e., the next period T2) begins. Thus, the LCD module 100 can display an image corresponding to the completely renewed image data by the display unit 10 when each period T2 begins, thereby preventing tearing effect from occurring.

In the first and second renewing method, if the working frequency of the CPU 80 is lower than the working frequency of the LCD module 100, each operation of renewing stored data may occur after a plurality of operations of displaying images according to the currently stored image data (i.e., each period T3/T4 comes after a plurality of periods T2). However, according to the methods of the first and second renewing methods, if only each period T3/T4 ends before its proximate subsequent period T2 begins, the LCD module 100 can be prevented from reading incompletely renewed data, and tearing effect is prevented.

After selecting renewing methods, the CPU 80 and the LCD module 100 works according to the above method to continually display a plurality of images, and the images form the video played by the electronic device 200. Until the video is finished playing, i.e., all image data of the video is displayed by the LCD module 100, the LCD module 100 and the CPU 80 stop working.

Additionally, the CPU 80 can also be installed in the LCD module 100 when fabricating the LCD module 100, e.g., integrated with a conventional processor of the LCD module 100. The synchronous signal generated by the CPU 80 can also be set in a reverse phase, i.e., set to be in a low electric level in the standby intervals T1 and set to be in a low high level in the operation periods T2. Correspondingly, the CPU is driven to renew stored data by the ascend edges of the synchronous signal in the first renewing method and is driven to renew stored data by the descend edges of the synchronous signal in the second renewing method.

Since the present LCD module 100 has the timing unit 30 sending synchronous signals corresponding to the working status of the LCD module 100 and sending the synchronous signals to the CPU 80, the CPU 80 can regulate the operating periods of renewing the image data temporarily stored in the temporary storage unit 20. Thus, the LCD module 100 is prevented from displaying an image corresponding to incompletely renewed image data, i.e., including both a part corresponding to the renewed data and another part corresponding to the old data. Therefore, the error of tearing effect is effectively prevented.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A liquid crystal display (LCD) module, comprising:

a display unit for displaying images;

a temporary storage unit electronically connected to the display unit for temporarily storing image data;

a timing unit electronically connected to the display unit, and a central processing unit (CPU) electronically connected to the temporary storage unit and the timing unit;

wherein the display unit displays images corresponding to the image data stored in the temporary storage unit, the timing unit generates a synchronous signal corresponding to the displaying operation; and the CPU receives the synchronous signal and renews the image data stored in the temporary storage unit according to the synchronous signal; and wherein if a time of each operation of renewing the stored data is equal to or shorter than a standby time between two adjacent operations of displaying images according to the stored data, the CPU is driven to renew the data stored in the temporary storage unit when the operations of displaying images ends; and if the time of each operation of renewing the stored data is longer than the standby time between two adjacent operations of displaying images according to the stored data, and the CPU is driven to renew the data stored in the temporary storage unit when the operations of displaying images begins.

2. The LCD module as claimed in claim 1, wherein the synchronous signal is set to be in a low electric level when the display unit is standby, and the synchronous signal is set to be in a high electric level when the display unit is displaying images.

3. The LCD module as claimed in claim 2, wherein descending edges of the synchronous signal are used to drive the CPU to renew the data stored in the temporary storage unit when the time of each operation of renewing the stored data is equal to or shorter than the standby time between two adjacent operations of displaying images according to the stored data.

4. The LCD module as claimed in claim 2, wherein ascending edges of the synchronous signal are used to drive the CPU to renew the data stored in the temporary storage unit when the time of each operation of renewing the stored data is longer than the standby time between two adjacent operations of displaying images according to the stored data.

5. A method for displaying images, comprising:

providing an LCD module and storing image data in the LCD module;

providing a CPU electronically connected to the LCD module;

displaying images corresponding to the stored image data;

generating a synchronous signal corresponding to the displaying operations;

using the CPU to receive the synchronous signal and renew the stored image data according to the synchronous signal, wherein the CPU renews the stored image data on descending edges or ascending edges of the synchronous signal; and displaying new images according to the renewed image data.

6. The method as claimed in claim 5, further comprising further storing the stored image data in the CPU.

7. The method as claimed in claim 5, wherein the CPU renews the stored image data on the descending edges of the synchronous signal when the time of each operation of renewing the stored image data is equal to or shorter than the standby time between two adjacent operations of displaying images according to the stored image data.

8. The method as claimed in claim 5, wherein the CPU renews the stored image data on the ascending edges of the synchronous signal when the time of each operation of renewing the stored image data is longer than the standby time between two adjacent operations of displaying images according to the stored image data.

* * * * *